United States Patent [19]

Arnold

[11] Patent Number: 4,722,389

[45] Date of Patent: Feb. 2, 1988

[54] WELL BORE SERVICING ARRANGEMENT

[75] Inventor: Ronald D. Arnold, Missouri City, Tex.

[73] Assignee: Texas Iron Works, Inc., Houston, Tex.

[21] Appl. No.: 893,807

[22] Filed: Aug. 6, 1986

[51] Int. Cl.[4] ..... E21B 33/05

[52] U.S. Cl. ..... 166/70; 166/285

[58] Field of Search ..... 166/285, 70, 89, 75.1; 175/207, 216, 214

[56] References Cited

U.S. PATENT DOCUMENTS

| | | | |
|---|---|---|---|
| Re. 21,677 | 12/1940 | Tremolada | 175/216 X |
| 3,076,509 | 2/1963 | Burns et al. | 166/70 |
| 3,479,829 | 11/1969 | Goodman | 166/285 X |
| 3,720,264 | 3/1973 | Hutchison | 166/311 |
| 3,750,749 | 8/1973 | Giroux | 166/95 |
| 3,828,852 | 8/1974 | Delano | 166/70 X |
| 3,971,436 | 7/1976 | Lee | 166/70 |
| 4,266,620 | 5/1981 | Wolgammot et al. | 175/215 |
| 4,427,065 | 1/1984 | Watson | 166/70 X |
| 4,520,879 | 6/1985 | MacElvain | 173/57 |

OTHER PUBLICATIONS

International Publication No. WO 80/02717, (Inventor: Wallgren, Alf; International Application No. PCT/SF 80/00158; International filing date 30 May 1980).

*Composite Catalog of Oil Field Equipment & Services,* Bower, p. 730, vol. 1, 1962–63.

*Primary Examiner*—Stephen J. Novosad
*Assistant Examiner*—David J. Bagnell
*Attorney, Agent, or Firm*—Jack W. Hayden

[57] ABSTRACT

For use with a top drive power unit supported for connection with a well string in a well bore to selectively impart longitudinal and/or rotational movement to the well string, a feeder for supplying a pumpable substance such as cement and the like from an external supply source to the interior of the well string in the well bore without first discharging it through the top drive power unit including a tubular member or mandrel extending through an outer housing which is sealably and rotatably supported thereon for relative rotation between the outer housing and the tubular member. The mandrel and outer housing have flow passages for communicating the pumpable substance from an external source to discharge through the outer housing and mandrel into the interior of the well string below the top drive power unit. The mandrel includes an arrangement to releasably position a pump down plug for discharge into the well string and for positioning a barrier to selectively dislodge the barrier into the well string through the mandrel.

2 Claims, 2 Drawing Figures

WELL BORE SERVICING ARRANGEMENT

DESCRIPTION OF THE PRIOR ART

Heretofore in the drilling of well bores for oil and gas wells, a suitable drilling mast has been first positioned on location with a crown block at the top of the mast over which extends a cable from the draw works drum. The cable extends from the group of pulleys forming the crown block back and forth through a group of pulleys forming what is termed a travelling block to suspend the travelling block from the crown block for longitudinal up and down movement relative to the drilling mast and crown block. A swivel is hung on the hook that is rotatably supported on the travelling block which swivel includes a gooseneck with which a drilling fluid line may be connected for discharging fluid through the swivel. The swivel includes a tubular member, or stem, that is rotatably supported in the swivel and a noncircular longitudinally extending member referred to as a "kelly" is connected at the lower end of the stem, with the lower end of the "kelly" connected to the well string.

Rotation is imparted to the well string to drill the well bore by a rotary table which is provided with a kelly bushing supported therein that engages and rotates the noncircular kelly and the well string. The swivel is constructed to accommodate rotation of the well string while drilling fluid is discharged into the gooseneck from an external source and then conducted through the swivel stem, through the kelly and discharged into the well string.

More recently, the use of a top drive unit, or top drive power unit is employed to rotate the drill pipe, or well string in the well bore rather than employ a rotary table, kelly busing and kelly. In such arrangement, spaced guide rails extend vertically above the well bore in the earth's surface and are supported in such position in any suitable manner such as by securing to a drilling mast or the like. A frame is movable along the guide rails and supports the top drive power unit thereon. The travelling block, through the hook and swivel support the frame for movement longitudinally along the guide rails. The top drive power unit includes a motor which is connected by suitable gear means with a rotatable member both of which are supported on the frame that is movable longitudinally along the guide rails and which frame is elevated or lowered along the guide rails by the elevator and crown block when it is desired to "trip" the drill pipe or well string into or out of the well bore or when the well string is moved longitudinally in the well bore during drilling and servicing operations. The stem of the swivel communicates with the upper end of the rotatable member of the power unit in a manner well known to those skilled in the art for supplying fluid through the top drive unit to the kelly and well string connected thereto and depending therefrom. The swivel functions in the same manner as it does in those instances where a rotary table is employed to rotate the drill string by means of a kelly and enables drilling fluid to be supplied to the drill string that is threadedly engaged with the lower end of the rotatable member of the top drive power unit as the well string is rotated or moved up and down. Apparatus referred to as elevators are secured to and suspend from the frame in a suitable manner well known in the art, the elevators being employed when it is desired to lower joints of drill string into the well bore, or remove such joints from the well bore.

DESCRIPTION OF THE INVENTION

From time to time well operations require the use of pumpable substances, such as cement, epoxy resins, or the like and it may be desired to supply such pumpable substances to the well string without first discharging such substances through the swivel and top drive power unit without interfering with selective desired longitudinal and/or rotational movement of the well string by the top drive unit. For example, the practice of setting liners in a casing in a well bore is well known and has been utilized for many years. There are several generally accepted arrangements for accomplishing such purpose.

In one arrangement, a liner is secured on a tubular member forming part of a well string and a hanger is mounted on the outside of a liner. The tubular member includes an extension which extends downwardly into the liner and a seal arrangement is positioned between the tubular member and the liner for accomplishing the cementing as desired.

The liner is supported on the tubular member in a well known manner which enables them to be disconnected and the liner then positioned on the casing in the well bore in a well known manner. The well string is manipulated by powering the top drive unit to rotate it, and the well string can be reciprocated by raising and lowering the top drive unit for conditioning the well bore before discharging cement, or any suitable bonding agent into the well string for securing the liner in place. The well string and liner can be rotated after the liner hanger is set and before the cement hardens.

Where a top drive power unit, instead of a rotary table, kelly and kelly bushing are employed to rotate a well string during well bore servicing operations, such as for example only, cementing a liner in a well bore it is desirable to conduct the cementing or bonding agent to the well string in a manner to by-pass the top drive unit to avoid possible damage or deleterious affect upon any portion or component of the top drive power unit.

In some instances, a liner is set in a well bore without hanging it in a casing.

The present invention provides an apparatus and method for accomplishing the above and other problems.

This invention also relates to a top drive power system wherein the traditional rotary table, kelly bushing and kelly are not required because the drill string is rotated directly by the top drive powered system suspended from the travelling block. Such top drive systems possess many advantages some of which is the fact that about two-thirds of the connections required with conventional techniques are eliminated thereby significantly reducing hazard exposure. Further, when drilling, only smooth pipe is rotating at the floor level thus lessening the danger of heretofore used rotaty equipment.

This invention further relates to a feeder for a top drive power unit system having a fixed part and a rotary part. The fixed part surrounds the rotary part and includes the cement or bonding agent feed line. The rotary part houses the cement pump down plug and the pump down plug holder. The feeder arrangement is interposed between the motor assembly of the top drive unit and the top of the well string whereby during cementing the bonding agent is kept away from the drive assembly of the top drive system so as to prevent fouling by the cement of the top drive unit.

In addition, the invention relates to the method of cementing a well using a top drive power unit system including the step of introducing cement bonding agent at a point in the system between the top of the well string and the bottom of the top drive power unit.

The invention herein broadly relates to an assembly having a top drive arrangement for rotating and longitudinally moving a well string in a bore hole including means for feeding cement to the well string in the bore hole in order to set a liner in a casing of the bore hole comprising a feeder means interposed between the bottom of the top drive drilling arrangement and the top of the drill string or well string, the feeder including, if desired, upper and lower threaded connections for make-up and break-out respectively between the feeder and the top drive unit and well string. The feeder is provided with at least one cement feed line from an external supply source in communication with the feeder means said feeder means having a mandrel mounted for rotation along with the top drive unit and the well string, said mandrel having a passage to communicate fluid to the well string, said mandrel extending through a housing sealably and rotatably supported thereon to accommodate relative rotation between said mandrel and housing, said housing having port means for communicating with the cement feed line, said mandrel including a pump down plug holder for releasing a plug into the well string, and means to discharge a barrier into the well string when desired.

Another object of the present invention is to provide a well servicing unit including a mast, a crown block thereon, a cable extending from a powered drum, over the crown block and weaved back and forth between a travelling block to suspend the travelling block from the crown block in the mast for longitudinal movement relative to the mast, said mast supporting longitudinal, and preferably substantially vertical, guide rails extending upwardly from the earth's surface adjacent the well with a top drive power unit thereon for rotating a well string and moving it longitudinally in the well as desired. A swivel is suspended from the travelling block and supports the top drive unit for longitudinal movement by the crown block along the guide rails and a feeder is interposed between the bottom of the top drive unit and the top of the well string for conveying pumpable substances from an external source of supply to the feeder to discharge into the well string without conducting it through the top drive unit.

Another object of the present invention is to provide a method of conducting servicing operations in a well bore, such as cementing, comprising the steps of moving a power unit longitudinally of a mast in order to accommodate longitudinal movement or reciprocation in the well bore of a well string suspended from the top drive unit, rotating the power unit and the associated well string and supplying a pumpable substance to the well bore in which the well string is manipulated by introducing the pumpable substance at a point below the top drive power unit and into the well string.

DESCRIPTION OF THE PREFERRED EMBODIMENT

The present invention will be described in detail as it relates to one servicing operation, namely cementing a liner in a well bore. However, it can be appreciated that the present invention can be employed in any situation where it is desired to convey a pumpable substance to a well string without first conveying it through a top drive power unit which is connected to the top of the well string to effect longitudinal and/or rotational movement of the well string during the servicing operations or otherwise during well bore drilling operations while the pumpable substance is supplied to the well string.

In one form of cementing operation in a well bore, a column of bonding agent such as a cement slurry is preceded through the well string by what is termed a bottom plug and a top plug at the upper end of the slurry is discharged down through the well string. The bottom plug displaces fluid in the casing and inhibits combining of the slurry and well fluid, such bottom plug also enabling the cement slurry to enter the well bore annulus and cement a liner, for example, in the well bore after the liner has been lowered into the well bore on a well string and released therefrom and hung on the casing.

Figure 1:
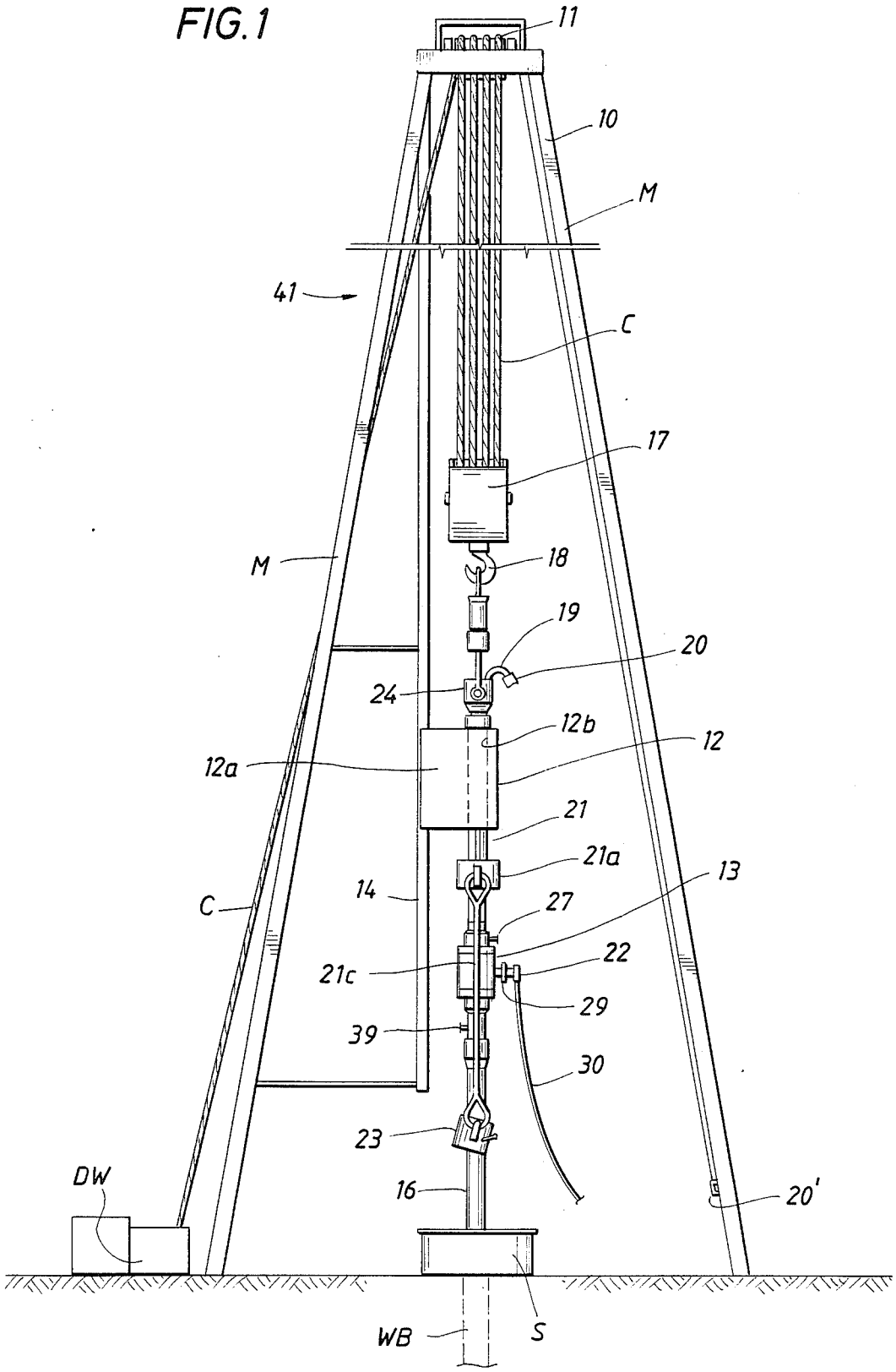
FIG. 1 is a schematic representation of a mast arrangement adjacent a well bore with components of the present invention illustrated.

Attention is first directed to FIG. 1 wherein a mast assembly is referred to generally by the numeral 41 and includes suitable longitudinally extending members M supported on the earth's surface adjacent the well bore WB in the earth's surface. A well string 16 is shown as extending into the well bore, which well string 16 is connected at its upper end to the lower end of a feeder 13 as will be described. The member S at the top of the well bore provides a support for use during "tripping" the pipe, or well string. Schematically illustrated at 11 is a crown block which includes a plurality of rotatable pulleys. As is well known to those skilled in the art, suitable cable means C extends from a draw works drum DW powered by a draw works which extends up over the pulleys in the crown block 11 and down to what is termed the travelling block 17. The cable C extends back and forth between the pulleys in the crown block 11 and travelling block 17, with one end of the cable secured to a portion of the mast 10 or a suitable anchor represented at 20'.

Laterally spaced, longitudinally extending, preferably vertical, guide rails 14 are supported by the mast 10 and extend longitudinally adjacent the well bore WB which receives the well string 16 as diagramatically represented in FIG. 1. A suitable frame **12*a* is provided for movement along the spaced guide rails 14, such frame having secured therewith the swivel 24 which is suspended from the hook 18 that in turn is rotatably supported by the travelling block 17. The swivel 24 is provided with a gooseneck 19 for connection with a drilling fluid line 20 whereby drilling fluid may be supplied from an external source to the swivel for discharge through the rotatable stem 12*b* of the top drive power unit schematically represented at 12 which is supported by the frame 12*a* for movement along the guide rails 14. A suitable power source, the details of which are not illustrated, are also supported on the frame 12*a* for imparting rotation to the rotatable tubular member or hollow stem 12*b* of the top drive power unit, which stem is connected at its upper end with a rotatable tubular member that depends from the swivel 24** and at its lower end to a sub which connects to the upper end of well string 16, or directly to the upper end of the well string.

Also suspended from the frame 12*a* is a pair of diametically opposed support members 21 depending from the power unit 12 and having a circular member 21*a* at their lower end on which are pivotally supported links 21*c*. The links 21*c* are pivotally connected at their lower ends with the elevator 23 as illustrated in FIG. 1 of the drawings. The elevator is employed when the well string is being "tripped", that is when it is being lowered into the well bore joint by joint, or removed from the well bore by disconnecting one or more joints at a time from the well string. Otherwise, while conducting normal drilling operations or well servicing operations, the elevator 23 merely hangs alongside the well string 16, as shown so as to not interfere with rotation thereof, or longitudinal movement along with power unit 12. The structure of the power unit 12 and the arrangement of the various components associated therewith are well known to those skilled in the art.

Figure 2:
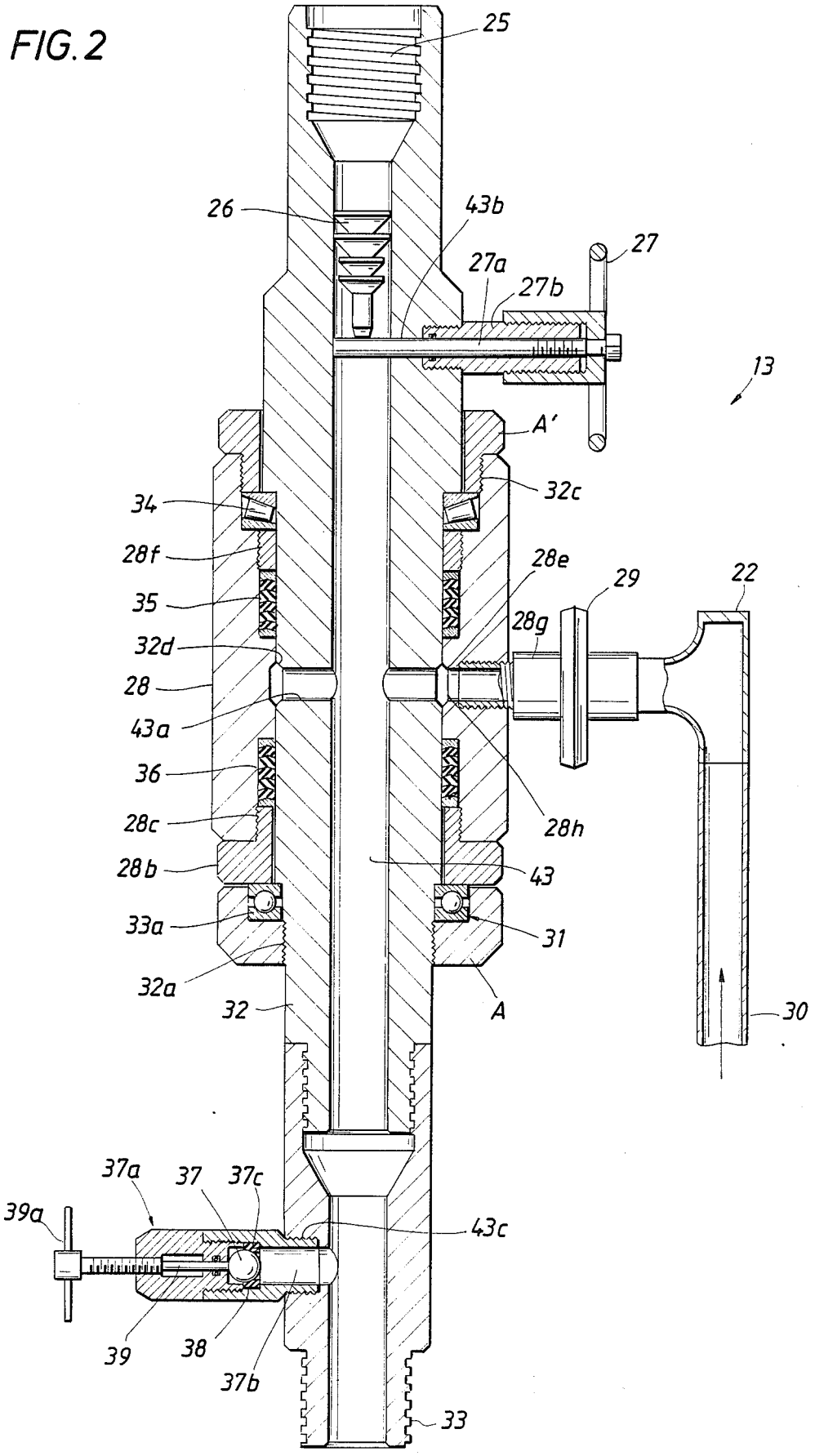
FIG. 2 is a sectional view primarily in cross section of the feeder schematic illustrated in FIG. 1.

The pumpable substance feeder for conveying pumpable substance from an external supply source to the top of the well string 16 while by-passing the top drive power unit 12 is shown at 13 in FIG. 1 and in greater detail in FIG. 2. The feeder means 13 includes a inner tubular member or mandrel 32 which extends longitudinally through outer tubular member or housing 28. The mandrel 32 is provided with a longitudinally extending passageway 43 therethrough which communicates with at least one intersecting lateral flow passage means 43*a* through said inner tubular member intermediate the ends of said longitudinal flow passage. More particularly, the lateral flow passage means 43*a* is shown in FIG. 2 as being positioned in the inner tubular member intermediate the ends of the outer tubular member 28.

Where the feeder means 13 is to be employed in a cementing servicing operation, additional lateral passage means 43*b* through the inner tubular member are provided which is spaced longitudinally relative to one end of the outer housing member 28 whereby a pump down plug positioning means 27*a* may be extended across the longitudinal flow passage 43 for positioning a pump down plug 26 for discharge through the feeder means 13 into the well string 16 connected with the feeder means by means of the threads 33 formed adjacent the lower end of the tubular member 32 for connection with the upper end of the well string 16. Suitable means such as a hand wheel 27 may be connected with the plunger 27*a* for withdrawing the plunger 27*a* from its position in the passage 43 as shown to permit movement of the plug 27 through the feeder 13 into the well string 16 when desired. The plunger 27*a* is threadedly and sealably connected in housing 27*b* that is threaded in passage 43*b* to accommodate movement of plunger 27*a* longitudinally of housing 27*b*.

Also, an additional lateral passage 43*c* is provided in the inner tubular member for receiving the housing 37*a* therein. The housing is provided with a passageway 37*b* having a seat 37*c* which may be formed by a split ring 38. A ball or barrier 37 is positioned in the housing 37*a* on the seat 37*c* as shown and is engaged with the plunger 39 sealably positioned and threadedly engaged in the housing 37*a* and movable longitudinally thereof by rotating the member 39*a*. When the stem 39 is moved longitudinally inwardly of the housing against the ball 37, the split ring 37*c* is separated to enable the ball to be discharged into the passage 37*b* for movement into the well string to accommodate hanging the liner by hydraulic pressure in the well string where such hanging procedure is desired.

The outer housing 28 is positioned relative to the inner tubular member 32 for sealable and relative rotation therebetween. The positioning means incudes a lower support or cap A which is secured to the inner tubular member 32 by any suitable means such as the threads 32*a*. A ball bearing arrangement 31 includes the race 33*a* supported in the cap A to accommodate axial thrust loads encountered by the feed means 13 and is retained by the lower ring 28*b* supported on the outer housing 28 by any suitable means such as the threads 28*c* as shown. A tapered roller bearing race 34 is provided adjacent the other end of the outer housing 28 as shown and is retained in position by means of the upper cap A' engaged with housing 28 by any suitable means such as threads 32*c* as shown to carry lateral or side thrust loads.

The seal means 35 and 36 between the inner tubular member 32 and the outer housing 28 is positioned so as to be on each side of, or to span the lateral flow passage means 43*a*. Also, a circumferencial groove as shown at 32*d* may be formed on the outer periphery or surface of the inner tubular member 32 and a mating groove 28*e* can be formed on the inner surface of the outer housing 28 to better accommodate continuous fluid flow from an external source of the pumpable substance to the longitudinal passage 43 in the inner tubular member 32. The upper end of ring 28*b* serves as a retainer for the lower seal means 36 and a suitable retainer ring 28*f* may be engaged by threads as shown in the outer housing 28 for retaining the seal means 35 in position and to assist in supporting.

It can be appreciated that suitable shoulders are provided in the outer housing 28 on which the seal means 35 and 36 are seated as shown.

An inlet conduit 30 is provided for connection with an external supply source for receiving the pumpable substance therethrough to discharge it through connection 22 and a "WECO" wing fastener 29 which secures the pipe or conduit 30 to the connection 28*g* that is threadedly secured in the lateral passage 28*h* of outer member 28 that communicates with groove 28*e*, groove 32*d* and the lateral passage means 43*a* in the inner tubular member.

The feeder means 13 is connected by suitable means such as threaded connection 25 to the lower end of the hollow stem 12*b* of the top drive power unit 12 whereby rotation and longitudinal movement may be transmitted from the top drive power unit through the feeder means 13 to the well string 16 connected therewith while the pumpable substance is discharged to the moving well string 16 without first passing the substance through the top drive unit 12.

As previously noted, where well bore servicing operations require the use of a pumpable substnce that may have deleterious affects on the top drive power unit 12, the feeder means 13 may be connected with the rotatable stem 12*b* of the top drive power unit and the conduit or pipe 30 connected to communicate the pumpable substance through the outer housing 28 as described herein and as shown in the drawings. In such situation, the fluid is not discharged through the swivel 24 and then through the top drive power unit 12, rather the top drive power unit 12 is by-passed to avoid contamination or damage thereto. During the servicing operation where movement of the well string may be desired, such as in a cementing operation or in any other operation, the well string can be moved longitudinally and rotatably as desired without requiring that the fluid be first discharged through the top drive unit. For example, in cementing operations it may be desirable to condition the well bore by manipulating the well string during cementing operations. Such procedure may be accomplished while still accommodating flow of the pumpable substance to the well string while by-passing the top drive unit.

Before the cementing operation is completed, or while it is being performed, it sometimes is desirable to rotate the well string in an endeavor to assure a better cementing operation in the well bore adjacent the liner and liner hanger. This also may be accomplished by means of the present invention.

The foregoing disclosure and description of the invention are illustrative and explanatory thereof, and various changes in size, shape and materials as well as in the details of the illustrated construction may be made without departing from the spirit of the invention.

What is claimed is:

1. An assembly for connecting between the hollow, rotatable stem extending through a top drive power unit and a well string wherein drilling fluids are supplied to the stem for passage through the top drive power unit to the well string therebelow, the well string being rotatable and movable longitudinally in a well bore while supplying a pumpable substance to the hollow stem and well string without first conducting the substance through the top drive power unit, said assembly comprising:

an outer tubular member;

a rotatable inner tubular member with a longitudinal passage therethrough;

said rotatable inner tubular member and longitudinal passage therethrough extending through said outer tubular member;

said rotatable inner tubular member having connection means connectable with the hollow stem for communicating the longitudinal passage in said inner tubular member with the hollow stem beneath the top drive power unit and with the well string;

said outer tubular member having lateral flow passage means to communicate with the longitudinal passage extending through said inner tubular member;

said rotatable inner tubular member having a circumferential groove on its outer surface intersecting said lateral flow passage means and said outer tubular member having a mating circumferential groove formed on its inner surface which groove means cooperate to form a continuous fluid flow passage in each said inner and outer tubular members communicating with said lateral passage means;

bearing means to accommodate rotation of said inner tubular member by the top drive power unit relative to said outer tubular member;

seal means between said rotatable inner tubular member and outer tubular member on each side of said lateral flow passage means;

plunger means extending through said rotatable inner tubular member into the longitudinal passage therethrough for restricting access through the longitudinal passage in said inner rotatable tubular member; and means for withdrawing said plunger means from the longitudinal passage in said rotatable inner tubular member.

2. The assembly of claim 1 including:

housing means;

means for communicating said housing means to said rotatable inner tubular member to communicate with the longitudinal passage therethrough;

ball means supported in said housing; and means to accommodate movement of said ball means from said housing means into the longitudinal passage of said inner rotatable tubular member.

* * * * *

UNITED STATES PATENT AND TRADEMARK OFFICE

CERTIFICATE OF CORRECTION

PATENT NO. : 4,722,389

DATED : February 2, 1988

INVENTOR(S) : Ronald D. Arnold

It is certified that error appears in the above-identified patent and that said Letters Patent are hereby corrected as shown below:

Column 3, line 35, change "weaved" to --reaved--;

line 68, change "schematic" to --schematically--.

Column 6, line 57, change "substnce" to --substance--.

Column 8, line 34, change "communicating" to --connecting--.

Signed and Sealed this

Thirtieth Day of August, 1988

*Attest:*

DONALD J. QUIGG

*Attesting Officer*

*Commissioner of Patents and Trademarks*